US010229793B2

(12) United States Patent
Maloney et al.

(10) Patent No.: US 10,229,793 B2
(45) **Date of Patent: *Mar. 12, 2019**

(54) CIRCUIT INTERRUPTERS HAVING METAL ARC CHUTES WITH ARC QUENCHING MEMBERS AND RELATED ARC CHUTES

(71) Applicant: Eaton Corporation, Cleveland, OH (US)

(72) Inventors: James Gerard Maloney, Industry, PA (US); Jeffrey Scott Gibson, Hookstown, PA (US); John Clark, Beaver, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 15/647,841

(22) Filed: Jul. 12, 2017

(65) Prior Publication Data

US 2019/0019636 A1 Jan. 17, 2019

(51) Int. Cl.

| | |
|---|---|
| ***H01H 9/44*** | (2006.01) |
| ***H01H 9/34*** | (2006.01) |
| ***H01H 9/36*** | (2006.01) |
| ***H01H 9/02*** | (2006.01) |

(52) U.S. Cl.

CPC ..... *H01H 9/44* (2013.01); *H01H 9/02* (2013.01); *H01H 9/345* (2013.01); *H01H 9/36* (2013.01)

(58) Field of Classification Search

CPC ..... H01H 9/44; H01H 9/02; H01H 9/345; H01H 9/36; H01H 71/02; H01H 71/521; H01H 71/528; H01H 2205/012; H01H 2209/062; H01H 21/04

USPC ..... 218/34, 37, 38, 41, 46, 76, 81, 103, 218/149–151, 156; 335/172

See application file for complete search history.

(56) References Cited

U.S. PATENT DOCUMENTS

| | | | |
|---|---|---|---|
| 2,769,066 | A | 10/1956 | Cellerini |
| 2,898,427 | A | 8/1959 | Nadeau |
| 3,071,666 | A | 1/1963 | Ellsworth et al. |
| 3,242,257 | A | 3/1966 | Jones et al. |
| 3,761,660 | A | 9/1973 | Jones |
| 4,081,852 | A | 3/1978 | Coley et al. |

(Continued)

OTHER PUBLICATIONS

American Society for Testing and Materials "Standard Test Method for Total Mass Loss and Collected Volatile Condensable Materials from Outgassing in a Vacuum Environment" *ASTM Designation*: E 595-93 (8 pages) (1993).

(Continued)

*Primary Examiner* — Edwin A. Leon
*Assistant Examiner* — William A Bolton
(74) *Attorney, Agent, or Firm* — Myers Bigel, P.A.

(57) ABSTRACT

Circuit interrupters such as breakers with a metal arc chute having a base and sidewalls extending outward from the base forming an open cavity, a movable arm holding a movable contact adjacent to the arc chute, a line conductor electrically connected to a stationary contact residing adjacent to the arc chute facing the movable contact and a three-dimensional molded arc quenching insert attached to the metal arc chute, and residing in the cavity of the metal arc chute between the stationary and movable contacts. The insert has an arc quenching material that optionally releases a gas such as hydrogen during an arcing event.

22 Claims, 7 Drawing Sheets

(56) References Cited

U.S. PATENT DOCUMENTS

| | | | | |
|---|---|---|---|---|
| 4,266,210 | A * | 5/1981 | Mrenna | H01H 73/18 335/201 |
| 4,503,408 | A | 3/1985 | Mrenna et al. | |
| 4,736,174 | A | 4/1988 | Castonguay et al. | |
| 4,786,885 | A | 11/1988 | Morris et al. | |
| 4,866,226 | A | 9/1989 | Hisatsune et al. | |
| 4,950,852 | A | 8/1990 | Goldman et al. | |
| 4,975,551 | A | 12/1990 | Syvertson | |
| 5,117,211 | A | 5/1992 | Morgan et al. | |
| 5,326,947 | A | 7/1994 | Edds et al. | |
| 5,359,174 | A | 10/1994 | Smith et al. | |
| 5,589,672 | A | 12/1996 | Uchida et al. | |
| 6,894,594 | B2 * | 5/2005 | Fello | H01H 71/524 335/172 |
| 7,094,986 | B2 | 8/2006 | Shea | |
| 7,285,742 | B2 | 10/2007 | Kinzler et al. | |
| 7,358,837 | B2 * | 4/2008 | Puskar | H01H 71/0257 335/6 |
| 7,674,996 | B2 | 3/2010 | Shea et al. | |
| 7,812,276 | B2 * | 10/2010 | Maloney | H01H 9/36 218/148 |
| 8,222,983 | B2 | 7/2012 | Zhou et al. | |
| 8,247,727 | B2 | 8/2012 | Zhou et al. | |
| 9,053,888 | B2 * | 6/2015 | Kim | H01H 71/0257 |
| 9,887,050 | B1 * | 2/2018 | Cox | H01H 9/362 |
| 2005/0263492 | A1 | 12/2005 | McCoy | |
| 2013/0284702 | A1 | 10/2013 | Hamada et al. | |
| 2015/0348720 | A1 | 12/2015 | Smeltzer et al. | |

OTHER PUBLICATIONS

U.S. Appl. No. 15/343,346, Cox et al., filed Nov. 4, 2016.

Ghunem, Refat Atef "Using the Inclined-Plane Test to Evaluate the Resistance of Outdoor Polymer Insulating Materials to Electrical Tracking and Erosion" *IEEE Electrical Insulation Magazine* 31 (5): 16-22 (2015).

Thangarajan et al. "A Comparison of Thermoset and Thermoplastic Arc Chutes in Molded-Case Circuit Breakers Under Fault Clearing" *IEEE Electrical Insulation Magazine* 31(2):30-35 (2015).

* cited by examiner

CIRCUIT INTERRUPTERS HAVING METAL ARC CHUTES WITH ARC QUENCHING MEMBERS AND RELATED ARC CHUTES

FIELD OF THE INVENTION

The present invention relates to circuit interrupters.

BACKGROUND OF THE INVENTION

Circuit interrupters such as circuit breakers are one of a variety of overcurrent protection devices used for circuit protection and isolation. The circuit breaker provides electrical protection whenever an electric abnormality occurs. In a typical circuit breaker, current enters the system from a power line and passes through a line conductor to a stationary contact fixed on the line conductor, then to a movable contact. The movable contact is fixedly attached to a pivoting arm. Arc chutes can be used to direct an arc away from the electrical contacts into the arc chute. The arc chute is situated proximate to the stationary contact of the circuit. As long as the stationary and movable contacts are in physical contact, current passes between the stationary contact and the movable contact and out of the circuit breaker to down-line electrical devices.

In the event of an overcurrent condition (e.g., a short circuit), extremely high electromagnetic forces can be generated. The electromagnetic forces can be used to separate the movable contact from the stationary contact. Upon separation of the contacts and blowing open the circuit, an arcing condition occurs. The breaker's trip unit will trip the breaker which will cause the contacts to separate. Also, arcing can occur during normal "ON/OFF" operations of the breaker.

Circuit breakers typically have one of two types of arc extinguishing apparatus. In miniature circuit breakers, typically used in residential and light commercial installations, the contacts are enclosed in a chamber in the resin casing and partially surrounded by a metal shield as shown for example by U.S. Pat. No. 4,081,852, the content of which is hereby incorporated by reference as if recited in full herein. In larger circuit breakers such as that described in U.S. Pat. No. 4,866,226, arc extinguishers typically comprise a plurality of stacked, substantially U-shaped arc extinguishing plates which surround the fixed and movable contacts of the circuit breaker. The content of this patent is hereby incorporated by reference as if recited in full herein. Various materials have been used for the arc chute and for the molded housing of the circuit breaker. See, U.S. Pat. No. 5,359,174, the content of which is hereby incorporated by reference as if recited in full herein.

For example, the arc chute can be held by molded housing walls of suitable material of a molded case circuit breaker. Arc-extinguisher side walls have in the past been formed of fibers within a melamine resin matrix, as disclosed in U.S. Pat. No. 4,950,852. Such resins are used to provide a source of arc-quenching gaseous molecular compounds released based on the heat of the arc. U.S. Pat. No. 4,975,551 discloses an arc extinguishing composition comprising an arc-interrupting compound, such as melamine, which is disposed along the path of the arc in combination with a binder composition. U.S. Pat. No. 3,761,660 discloses an arc interrupting composition of alumina and melamine for the arc-exposure walls or surfaces of electric circuit interrupting devices. The patents in this paragraph are incorporated by reference as if recited in full herein.

Despite the above, there remains a need for cost-effective molded case circuit breakers that can meet UL® 489 requirements. As is known to those of skill in the art, UL® 489 requires that these circuit breakers meet specific construction and testing requirements to provide necessary protection while requiring little or no maintenance. These types of circuit breakers have an enclosed molded case which provides personal safety as well as proper dielectric clearances. The scope of the UL® 489 standard for molded case circuit breakers includes miniature circuit breakers, molded case circuit breakers and insulated case circuit breakers. These circuit breakers are typically rated 10-6000 A and up to 600 Vac and 500 Vdc.

SUMMARY OF EMBODIMENTS OF THE INVENTION

Embodiments of the invention are directed to circuit interrupters with a three-dimensional rigid or semi-rigid arc quenching member overlying some surfaces of a metal (electrically conductive) arc chute.

The arc quenching member can be a molded body comprising alumina trihydrate (ATH).

Embodiments of the invention provide a metal arc chute with an ATH and resin molded member thereon held in a glass polyester molded circuit breaker case. The arc-quenching of the ATH molded material can produce gases shown to quench an arc during successive short circuit shots on each pole during single pole UL®489 short circuit testing allowing the molded case circuit breaker to interrupt circuit operation and pass UL®-489 guidelines.

Some embodiments are directed to circuit breakers that include: a molded circuit breaker case of molded glass polyester; a metal arc chute having a base and first and second sidewalls that are laterally spaced apart and extend in a length direction, the metal arc chute comprising an open cavity with the base providing a floor of the open cavity; a rigid or semi-rigid three dimensional arc quenching member having first and second sidewalls that are laterally spaced apart and extend in the length direction coupled to the arc chute and residing in the cavity of the arc chute; a movable arm holding a contact adjacent the arc chute; and a line conductor electrically connected to a stationary contact residing adjacent to the arc chute facing the contact on the movable arm.

The arc quenching member comprises a molded body comprising alumina trihydrate (ATH).

The arc quenching member can have a molded body formed of: (i) about 70% mineral filler of which a majority is alumina trihydrate (ATH); (ii) about 10% chopped fiberglass reinforcement; and (iii) a range of about 16%-18% of a thermosetting polyester resin and styrene monomer.

The first and second sidewalls of the arc quenching member can have respective first and second primary wall segments that extend in the length direction and abut a corresponding first and second sidewall of the arc chute.

At least one of the first and second sidewalls of the arc quenching member can have at least one secondary wall segment that is perpendicular to the primary wall segment.

The at least one secondary wall segment can be a plurality of secondary wall segments, at least one extending about an external first end of the metal arc chute on an end away from a stationary contact.

The first and second sidewalls of the arc quenching member can each have a primary wall segment that extends in the length direction. The first and second sidewalls can each have at least one secondary wall segment that is perpendicular to the primary wall segment and extend outward away from the cavity.

The first and second sidewalls can each have a plurality of secondary wall segments that are spaced apart in the length direction. The arc quenching member can leave at least a major portion of the floor of the base of the arc chute exposed.

The at least one secondary wall segment can have a maximal thickness in the length direction that is greater than a maximal thickness of the primary wall segment, the thickness of the primary wall segment measured in a direction perpendicular to the length direction.

The maximal thickness of the primary wall segment can be in a range of about 0.03 inches and 0.06 inches. The maximal thickness of the secondary wall segment can be between 0.08 inches and 0.25 inches. A wall thickness of the sidewalls of the metal arc chute can be greater than the maximal wall thickness of the primary wall segment.

The metal arc chute can have first and second metal arc chutes that are adjacent and aligned in the length direction with a space therebetween. The first and second sidewalls of the arc quenching member can each have a primary wall segment that extends in the length direction, and at least one of the first and second sidewalls can have a secondary wall segment that is perpendicular to the primary wall segment and extends outward through the space between the first and second metal arc chutes away from the cavity.

The second metal arc chute can reside closer to the stationary contact than the first metal arc chute. The primary wall segment of the first and second sidewalls of the arc quenching member can terminate prior to an end portion of the second metal arc chute.

The primary wall segment of the first and second sidewalls of the arc quenching member can terminate adjacent opposing first and second ends of the first metal arc chute in the length direction.

The floor of the metal arc chute can resides on an internal planar wall of the molded circuit breaker case. The molded circuit breaker case can have an internal shaped cavity that holds the arc quenching member and the metal arc chute as a unit therein. The molded circuit breaker case can have a cylindrical channel for holding a fastener adjacent a line terminal assembly. The arc quenching member can have an end closest to the stationary contact that resides a distance between 0.40 inches and 0.80 inches from the fastener cylindrical channel.

A primary wall segment of the first and second sidewalls of the arc quenching member can extend a distance above the first and second sidewalls of the metal arc chute, and at least one secondary wall segment of the first and/or second sidewall can be perpendicular to the primary wall segment with a height that is less than the primary wall segment and the sidewalls of the metal arc chute.

The arc quenching member and the molded case circuit breaker can both have ATH and a common polyester resin, with the arc quenching member comprising more ATH by weight of the molded body than the molded case circuit breaker.

The floor of the base of the metal arc chute can be a closed surface. Primary wall segments of the first and second sidewalls of the arc quenching member can be conformal to the first and second sidewalls of the metal arc chute and angle outward from the base.

Other embodiments are directed to an arc chute assembly for a molded circuit breaker. The assembly includes: a metal arc chute having a base and first and second sidewalls that are laterally spaced apart and extend in a length direction, the metal arc chute comprising an open cavity with the base providing a floor of the open cavity; and a rigid or semi-rigid three dimensional arc quenching member having first and second sidewalls that are laterally spaced apart and extend in the length direction coupled to the arc chute and residing in the cavity of the arc chute leaving at least a major portion of the floor of the base of the arc chute exposed. The arc quenching member has a molded body that includes alumina trihydrate (ATH).

The arc quenching member molded body can include: (i) about 70% mineral filler of which a majority is the ATH; (ii) about 10% chopped fiberglass reinforcement; and (iii) a range of about 16%-18% of a thermosetting polyester resin and styrene monomer.

The first and second sidewalls of the arc quenching member can have respective first and second primary wall segments that extend in the length direction and abut a corresponding first and second sidewall of the arc chute. At least one of the first and second sidewalls of the arc quenching member can have at least one secondary wall segment that is perpendicular to the primary wall segment.

Other embodiments are directed to methods for operating a current interrupter. The methods include: providing a molded case circuit interrupter comprising glass polyester, the molded case circuit interrupter holding a metal arc chute with a molded arc quenching member held thereon, the molded arc quenching member comprising alumina trihydrate (ATH); and interrupting a circuit during single pole successive short circuit shots associated with a short circuit test defined by UL®-489 in response to directing an electrical arc into the metal arc chute and quenching an electrical arc in the arc chute with the molded arc quenching member.

Optionally, a base of the metal arc chute can reside on a planar internal wall of the molded circuit breaker case.

Optionally, the molded arc quenching member can include: (i) about 70% mineral filler with at least a major portion of the mineral filler including ATH; (ii) about 10% chopped fiberglass reinforcement; and (iii) a range of about 16%-18% of a thermosetting polyester resin and styrene monomer.

Optionally, the first and second sidewalls of the arc quenching member have respective first and second primary wall segments that extend in the length direction and abut a corresponding first and second sidewall of the arc chute, and at least one of the first and second sidewalls of the arc quenching member has at least one secondary wall segment that is perpendicular to the primary wall segment.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
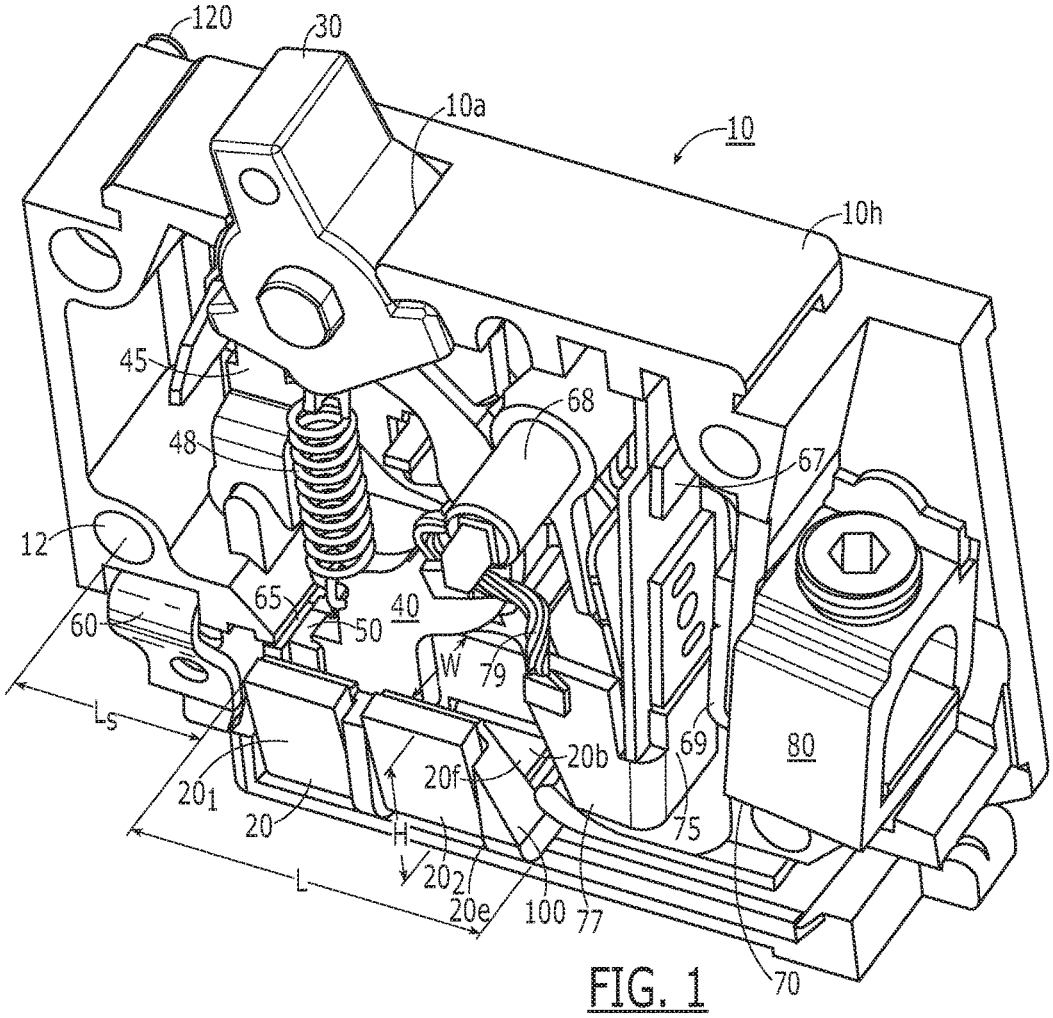
FIG. 1 is a partial side view of a circuit breaker according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 10, 10', 10", 10''').

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "Fig." (whether in all capital letters or not) is used interchangeably with the word "Figure" as an abbreviation thereof in the specification and drawings. In the figures, certain layers, components or features may be exaggerated for clarity, and broken lines illustrate optional features or operations unless specified otherwise. In addition, the sequence of operations (or steps) is not limited to the order presented in the claims unless specifically indicated otherwise.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "bottom", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass orientations of above, below and behind. The device may be otherwise oriented (rotated 90° or at other orientations) and the spatially relative descriptors used herein interpreted accordingly.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "about" refers to numbers in a range of +/−20% of the noted value.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

The term "non-ferromagnetic" means that the noted component is substantially free of ferromagnetic materials so as to be suitable for use in the arc chamber (non-disruptive to the magnetic circuit) as will be known to those of skill in the art.

As is well known to those of skill in the art, UL®-489 has a short-circuit test that requires that the tests be conducted at several values of short-circuit current. The UL®-489 standard is hereby incorporated by reference as if restated in full herein. A separate test sequence evaluates the maximum interrupting rating. Tests are conducted at the rated voltage(s) of the circuit breaker which is typically 240V, 480V or 600 V. Three-pole circuit breakers are tested under three-phase conditions during the maximum interrupting ability sequence. Each pole is also tested individually at a reduced current level. The circuit breaker must safely interrupt the short-circuit current and protect the rated wire in the circuit.

Turning now to the figures, FIG. 1 illustrates a circuit breaker 10 with a molded case or housing 10*h*, an arc chute 20, an arc quenching member 100 held on the arc chute 20, a movable contact arm 40 with an electrical contact 50, a line terminal assembly 60 with a line conductor and comprising a stationary electrical contact 65. The arc quenching member 100 can have a self-supporting shape before assembly to the metal arc chute 20. The movable contact arm 40 engages a handle 30 and a mechanism spring 48. The circuit breaker 10 can also include at least one trip cam 68, a cradle 45, a bimetal member 67, a collar assembly 80, a load terminal 69, a magnet 70, armature 75, shunt bracket 77, and shunt 79, for example.

The term "arc quenching member" refers to a member 100 on the arc chute 20 that can cooperate with the arc chute 20 and quench an arc caused by a circuit interruption in a manner that complies with the short circuit test requirements of UL®-489.

Figure 3:
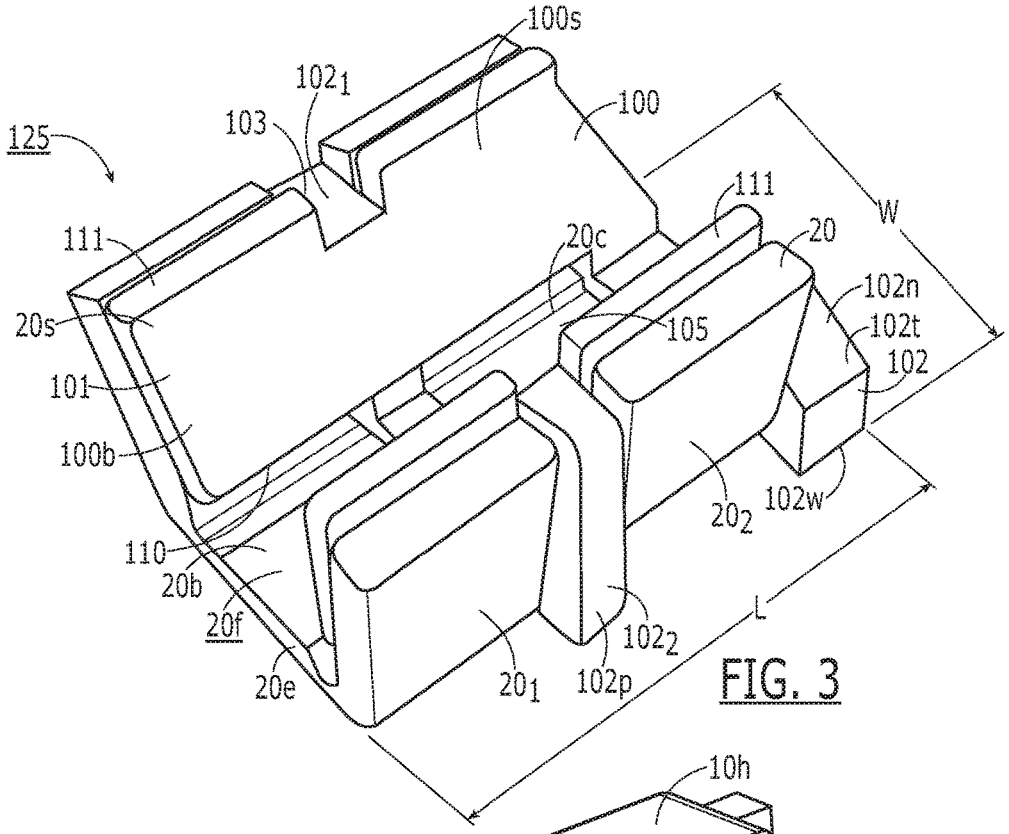
FIG. 3 is a side perspective view of arc chute assembly according to embodiments of the present invention.
Figure 5:
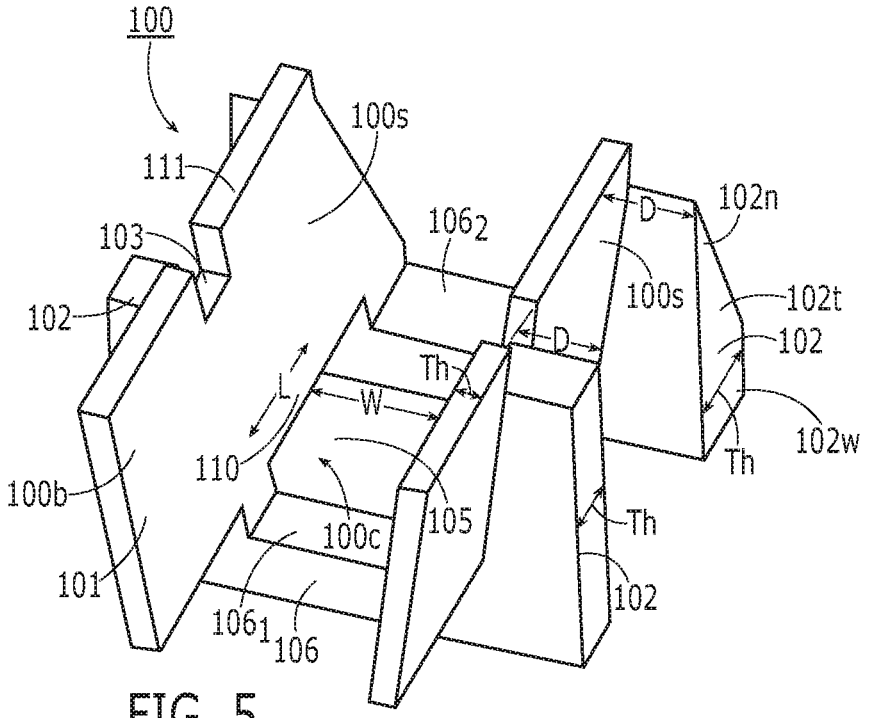
FIG. 5 is a top side view of the arch quenching member shown in FIG. 4 according to embodiments of the present invention.
Figure 6A:
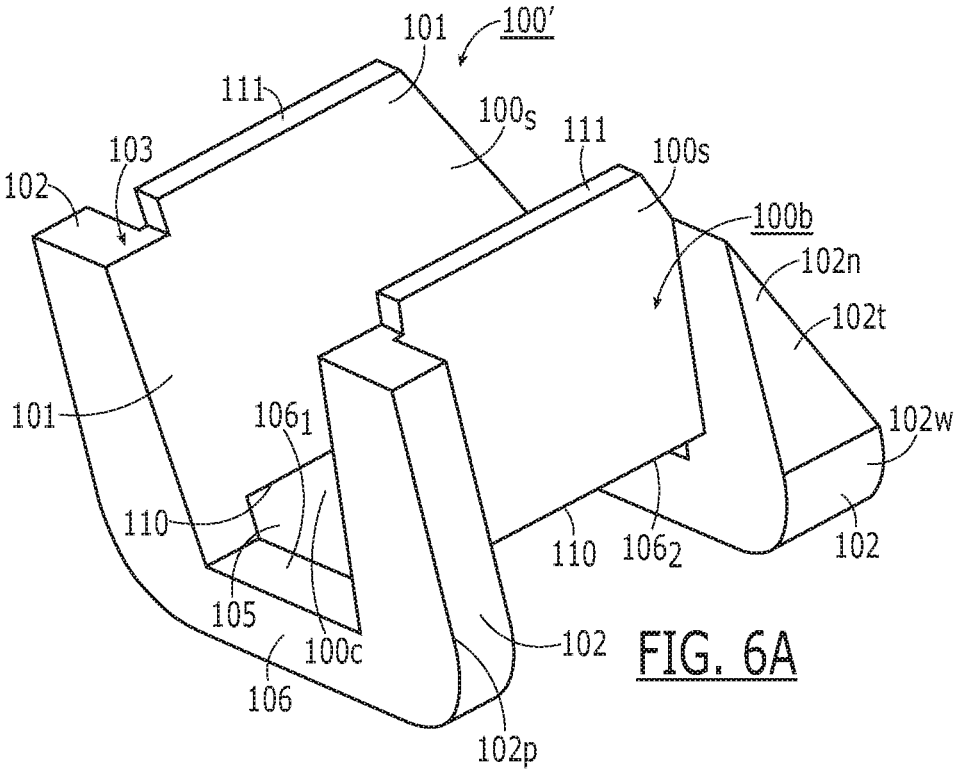
FIG. 6A is a greatly enlarged side perspective view of another embodiment of the arc quenching member according to embodiments of the present invention.

As shown in FIGS. 3, 5 and 6A, for example, the arc quenching member 100 can be a rigid or semi-rigid molded body 100*b* with sufficient structural rigidity to be self-supporting prior to assembly to the arc chute 20. The term "semi-rigid" means that the device may flex under load during operation and/or under an applied compressive force above a certain value such as at or above about 1 lbf (4.5 N) or at or above 5 lbf (at or above about 27 N) of applied compressive force when free-standing prior to assembly to the arc chute 20. The term "rigid" means that the member 100 does not flex when held by the arc chute 20 under normal loading and/or when free standing, prior to assembly, when exposed to about 1 lbf (about 4.5 N) or about 2 lbf (9 N) of applied compressive force. The arc quenching member 100 can be exposed to a 1-5 lbf force, more typically about 2 lbf, during operation of the circuit breaker 10.

The arc quenching member 100 can be a molded body 100*b* comprising alumina trihydrate (ATH).

In some embodiments, the molded body 100*b* comprises ATH present in an amount of between 30-90% by weight, more typically between about 60-80% by weight. Although ATH (a powder) is known to have relatively fragile properties even when molded with other material, the molded body 100*b* comprising ATH can have sufficient structural strength to remain intact without breaking or splintering when free-standing prior to assembly to the arc chute 20 even when exposed to small compressive loads to press-fit or otherwise assemble the arc quenching member 100 to the metal arc chute 20 and the assembly of the two components to the molded case 10*h*.

The arc quenching member 100 can be a molded body 100*b* formed from and/or having a composition comprising: (i) a filler (e.g., a mineral filler) in an amount of about 60%-80% by weight of the composition (i.e., the composition of the material for preparing the molded body 100*b* and/or by weight of the composition of the molded body 100*b* itself), of which a majority of this filler can be ATH; (ii) a fiber reinforcement (e.g., chopped fiberglass reinforcement) in an amount of about 5%-15% by weight of the composition; and (iii) a base thermosetting polymer resin and monomer (e.g., a base thermosetting polyester resin and styrene monomer) in an amount of about 15%-20% by weight of the composition. In some embodiments, the arc quenching member 100 can be a molded body 100*b* comprising: (i) about 70% by weight of a mineral filler of which a majority of this filler can be ATH; (ii) about 10% by weight of a chopped fiberglass reinforcement; and (iii) about 16%-18% by weight of a base thermosetting polyester resin and styrene monomer.

Example materials that may be present in a filler (e.g., a mineral filler) include, but are not limited to, ATH, fumed silica, precipitated silica, titanium dioxide, lithopone, zinc oxide, diatomaceous silicate, silica aerogel, iron oxide, diatomaceous earth, calcium carbonate, silazane treated silicas, silicone treated silicas, glass fibers, magnesium oxide, chromic oxide, zirconium oxide, alpha-quartz, clay (e.g., calcined clay), carbon, glass polyester, graphite, cork, cotton sodium bicarbonate, antimony trioxide, halogenated waxes (e.g., chlorinated and/or brominated waxes) and/or boric acid. In some embodiments, one or more materials in the filler may react to produce a gas such as, e.g., carbon monoxide and/or hydrogen gas. In some embodiments, the filler may comprise at least about 50% ATH by weight of the filler, and the amount of ATH in the a molded body 100*b* can exceed 50% by weight of the molded body 100*b* and/or by weight of the composition used to form the molded body 100*b*. In some embodiments, the filler can comprise between 30-95% ATH, more typically in a range of 50% and 90% ATH, such as about 50%, about 60%, about 70%, about 80% and about 90%. The arc quench member 100 can be brittle and/or have less strength than the molded case circuit breaker housing 10*h*.

Example base thermosetting polymer resins include, but are not limited to, epoxy (e.g., aliphatic and/or aromatic epoxy resins), polyester (e.g., halogenated polyester resins), polyurethane, phenolic, and/or alkyd resins.

Example fiber reinforcements include, but are not limited to, horn fiber, polymeric fiber (e.g., polyester fiber), carbon fiber and/or glass fiber, and/or aramid and/or basalt.

In some embodiments, a molded body 100*b* may be and/or comprise a material that emits a gas at a temperature greater than about 150° C. or 200° C. In some embodiments, a molded body 100*b* may be and/or comprise a material that emits a gas at a temperature in a range of about 150° C. to about 200° C.

The arc quenching member 100 can have a significantly reduced electrical conductivity relative to the metal arc chute 20 and may optionally be electrically non-conductive, i.e., electrically insulating. The term "significantly reduced" means that the electrical conductivity is at least 50% less than that of the metal chute when measured at 250 degrees C.

Figure 2:
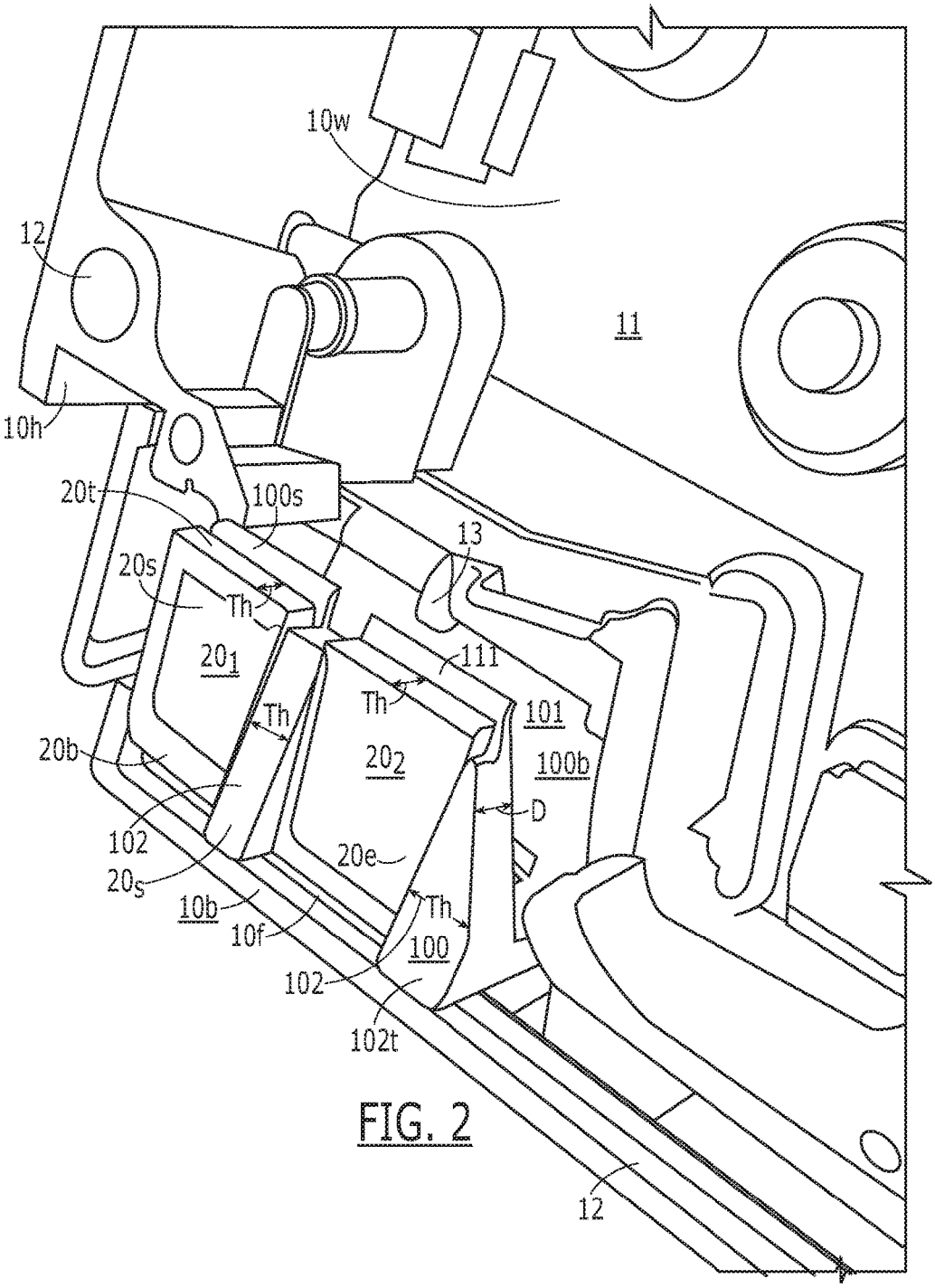
FIG. 2 is a greatly enlarged view of a portion of the circuit breaker shown in FIG. 1 with certain components removed to show the arc chute and arc quenching member according to embodiments of the present invention.

FIG. 2 is an enlarged view of a portion of the art arc chute 20 shown in FIG. 1. This arc chute 20 is metal (i.e., typically carbon steel) and includes a bottom or base 20*b* that can have a continuous solid floor 20*f*, first and second upwardly extending sidewalls 20*s* that are laterally spaced apart in a width direction "W". The sidewalls 20*s* extend upward from opposing sides of the base 20*b* to an upper portion 20*t*, providing a cavity 20*c* that allows the moving contact arm 40 to extend therein. As shown, the arc chute 20 includes aligned first and second arc chutes $\mathbf{20}_1$, $\mathbf{20}_2$, that are closely spaced apart in a length direction "L".

The circuit breaker case 10*h* can be a molded circuit breaker case (i.e., housing) that can comprise "glass polyester", i.e., polyester reinforced with glass fibers, typically randomly oriented glass fiber and/or fiberglass in a polyester resin base. The glass fibers can be in one or more different physical forms, for example, microspheres, chopped or woven.

In some embodiments, the molded circuit breaker case 10*h* is formed from a molding composition comprising glass fiber and/or fiberglass in an amount in a range of about 1% to about 50% by weight of the molding composition, a mineral filler in an amount in a range of about 20% to about 80% by weight of the molding composition, polyester resin in an amount in a range of about 10% to about 40% by weight of the molding composition, polyethylene and/or polystyrene in an amount in a range of about 0% to about 15% by weight of the molding composition, and/or styrene monomer in an amount in a range of about 1% to about 20% by weight of the molding composition. In some embodiments, the molded circuit breaker case 10*h* is formed from a molding composition comprising polyester resin, alumina (e.g., hydrated alumina), styrene, fiberglass and/or glass fiber. In some embodiments, glass fiber (e.g., glass fiber having a length of about 0.25 to 1 inch or to 1.5 or 2 inches or other sizes) may be present in the molding composition in an amount in a range of about 10% to about 30% by weight of the molding composition (e.g., about 20% by weight of the molding composition). In some embodiments, the filler may comprise less than 50% ATH by weight of the filler, and the amount of ATH in the a molded case circuit breaker 10*h* is below 50%, more typically between 10-30%, by weight of the molded case 10*h* and/or by weight of the composition used to form the molded case circuit breaker 10*h*.

The composite material for the molded circuit breaker housing 10*h* can have the same thermosetting polymer resin and fiber reinforcement, typically glass fiber reinforcement, as the arc quenching member 100. The composite material for the molded circuit breaker housing 10*h* can have a greater percentage of the polymer resin than the composite material for the arc quenching member 100. Each of these components 10*h*, 100 may also comprise ATH, but the arc quenching member 100 can have a greater amount of ATH relative to the composite material for the molded circuit breaker housing 10*h*, typically at least 10% more by weight, such as, for example, 10%-200% more by weight. The housing 10*h* may have at least 10% greater tensile strength, flexural strength and/or impact strength than the arc quenching member 100. The material for molding the arc quenching member 100 and the molded case circuit breaker 10*h* can be obtained from IDI Composites International, Noblesville, Ind.

The molded circuit breaker case 10*h* may be arc resistant and/or track resistant. In some embodiments, the molded circuit breaker case may have a spiral flow rate in a range of about 30 or 31 to 34 or 35 inches. In some embodiments, the molded circuit breaker case 10*h* may have a tensile strength in a range of about 6,000 psi to about 7,000 psi as measured in accordance of ASTM D-638, a flexural strength in a range of about 18,000 psi to about 22,000 psi as measured in accordance of ASTM D-790, an impact strength (notched isod) in a range of about 4 ft lb/inch to about 6 ft lb/inch as measured in accordance of ASTM D-256, a compressive strength in a range of about 21,000 to about 22,000 as measured in accordance of ASTM D-695, an arc resistance in a range of about 170 seconds to about 180 seconds as measured in accordance of ASTM D-495, a dielectric strength in a range of about 250 volts/mil to about 350 volts/mil (e.g., about 300 volts/mil) as measured in accordance of ASTM D-149, a water absorption in a range of about 0.05 to about 0.25 as measured in accordance of ASTM D-790, a specific gravity in a range of about 1.75 to about 2 as measured in accordance of ASTM D-792, a shrinkage in a range of about 0.5 mil/in to about 1.5 mil/in as measured in accordance of ASTM D-955, a volume resistivity in a range of about 1.5 ohms$\times 10^{13}$ to about 2.5 ohms$\times 10^{13}$ (e.g., about 2 ohms$\times 10^{13}$) as measured in accordance of ASTM D-257, a dielectric constant in a range of about 5.15 to about 5.35 at 60 Hz and/or about 4.80 to about 5.00 at $10^6$ Hz as measured in accordance of ASTM D-150, a heat deflection temperature at 264 psi in a range of about 350 to about 450 (e.g., 400) as measured in accordance of ASTM D-648, and/or a flame resistance rating of V-0 as measured in accordance with UL94 with a thickness of 0.062 inches.

It has long been desirable to be able to use a glass polyester molding material for circuit breaker cases (bases) enclosing and holding arc chutes. However, until now, despite many years of testing by at least one of the inventors and using different materials, such as using (carbon) steel arc chutes alone and using molded ATH arc chutes alone without steel, prototype miniature molded case circuit breakers with molded glass polyester cases were not able to pass the two short circuit shots on each pole at low individual pole short amperage as they failed to interrupt during a Z program evaluation described by UL®-489. Surprisingly, the use of a metal arc chute 20 with the molded arc quenching member 100 in a molded circuit breaker case 10*h* comprising glass polyester was able to successfully direct an arc into the arc chute 20 and quench the arc to pass the UL®-489 short circuit single pole test (for a 240 V/100 A rating breaker).

As will be appreciated by one of skill in the art, the materials, dimensions, shapes and positions of the components can impact performance and the ability to meet the short circuit testing requirements of UL®-489.

Figure 4:
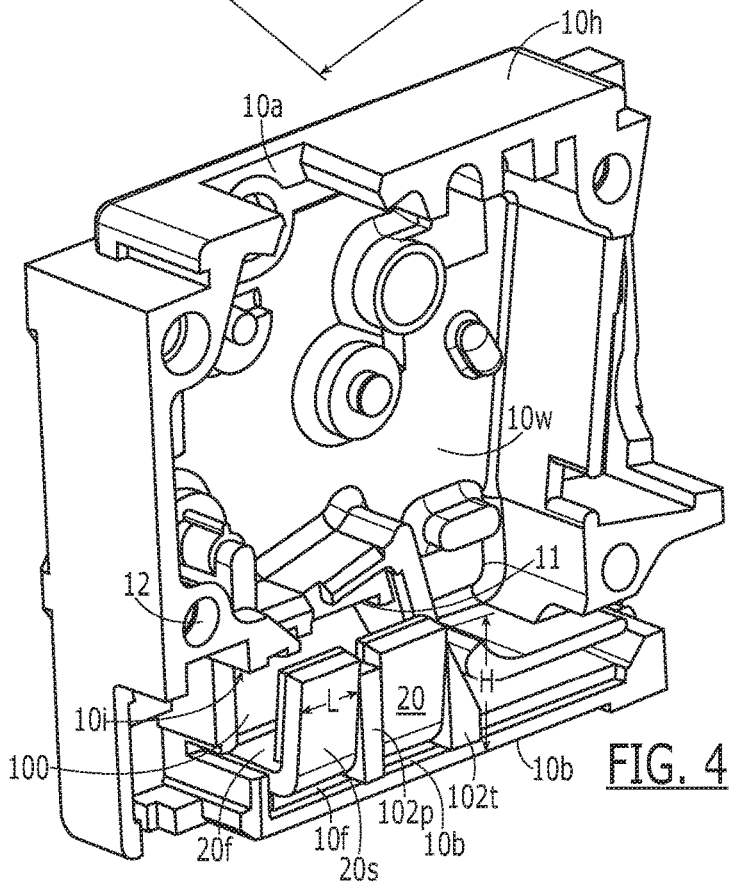
FIG. 4 is a partial section view of a circuit breaker with the arc chute assembly according to embodiments of the present invention.

Referring to FIGS. 2-4, the circuit breaker case 10*h* can have a sidewall 10*w* that has an internal cavity 11 that receives and holds one side of the arc chute 20 therein, typically abutting an inner surface 10*i* of the casing/housing 10*h*. This sidewall 10*w* can also have an aperture 10*a* for the handle 30 (FIG. 1). The base 10*b* of the breaker housing/casing 10*h* can comprise a planar floor 10*f* that extends in a portion of a length of the circuit breaker 10 in the length direction L between the trip cam 68 and the stationary contact 65 and that holds a bottom of the arc chute 20*b*. The bottom of the arc chute 20*b* can abut the floor 10*f* of the base 10*b*. The case 10*h* can have a projection 13 that can reside in a channel 103 in the sidewall 100*s* of the arc quenching member 100. The case 10*h* can have cylindrical channels 12 for fasteners 120 (FIG. 1) to attach mating sides of the housing together.

Referring to FIGS. 2 and 3, for example, the arc quenching member 100 can have a molded body 100*b* with sidewalls 100*s*. The sidewalls 100*s* have a bottom 110 and a top 111. The molded body 100*b* can have at least one end segment 106 that extends across a cavity 100*c* between the sidewalls 100*s*. As shown in FIG. 5 and FIG. 6A, for example, the at least one end segment 106 can comprise first and second end segments $\mathbf{106}_1$, $\mathbf{106}_2$ that span across the cavity 100*c* and are spaced apart in the length direction "L". The molded body 100*b* can have an open window 105 in the cavity 100*c* bounded on at least one end by cross segment 106 and bounded laterally in the length direction by the sidewalls 100*s*.

Referring to FIG. 5, the open window 105 can have a length L and width W that exposes at least a major portion of the underlying floor 20*f* of the metal arc chute 20 (FIGS. 1, 3 and 4). The metal exposure can help direct the arc into the arc chute during an arcing event and allow the circuit breaker 10 to meet the UL®-489 short circuit testing requirements.

As shown in FIG. 3, for example, the arc quenching member 100 can be coupled to the arc chute 20 and define a sub-assembly 125 that can be placed in the circuit breaker housing 10*h* as a unit. The three-dimensional shape of the molded body 100*b* can correspond to and/or conform to the shape of the arc chute 20 so as to provide a cavity 100*c* and upwardly extending sidewalls 100*s*. The sidewalls 100*s* may taper outward from the base 20*b* at an angle of inclination that corresponds to that of the sidewalls 20*w* of the arc chute 20. The arc quenching member 100 can be press-fit against the metal arc chute 20 to define a unit 125 for placement in the cavity 11 of the molded casing 10*h*. The arc quenching member 100 can be directly mechanically (i.e., frictionally) affixed to only the sidewalls 20*s* of the arc chute 20 without requiring adhesives or bonding.

Referring to FIGS. 4 and 5, the width W of the open window 105 can correspond to at least a major portion of a width of the floor 20*f*, typically 50%-110% thereof. The length L of the open window 105 can be at least 50% of the length of a sidewall 20*s* of the arc chute 20, typically 50-110% of the length of a sidewall 20*s*. The arc chute 20 can be devoid of arc plates as shown. The primary segments 101 of the arc quenching member 100 can be co-planar over their entire extent with a respective sidewall 20*s* of the arc chute 20.

The sidewalls 100*s* can have a primary planar segment 101 that extends parallel to the length direction L and at least one secondary wall segment 102 that is perpendicular to the primary planar segment 101, shown as a plurality of secondary wall segments 102, at least one on each side of the chute cavity 20*c*.

The at least one secondary wall segment 102 can have a thickness Th that is greater than a thickness Th of the primary wall segment 101 of the sidewalls 100*s*. The at least one secondary wall segment 102 can extend in the width dimension W for a distance D that is greater than a thickness of the sidewalls 20*s* of the metal arc chute 20. The primary wall segments 101 can have a thickness Th that is less than a thickness of the arc chute sidewalls 20*s* and less than a maximal thickness of the at least one secondary wall segment 102. The primary wall segments 101 can have a thickness Th that is between about 40-50% of the thickness of the sidewalls 20*s* of the arc chute 20. The primary wall segments 101 can have a thickness that is in a range of about 0.02 inches and 0.10 inches, more typically about 0.04 inches. One or more of the at least one secondary wall segment 102 can have a maximal thickness that is in a range of about 0.25 inches to about 0.08 inches, more typically in a range of about 0.1 inches to about 0.90 inches, such as about 0.096 inches.

Referring to FIG. 3, for example, the at least one secondary wall segment 102 can include first and second laterally spaced apart secondary wall segments, a first one $\mathbf{102}_1$ that extends outward from the cavity 20*c* of the arc chute on a first side of the arc chute 20 and a second one $\mathbf{102}_2$ that extends outward from the cavity 20*c* on the second side of the arc chute 20.

The at least one secondary wall segment 102 can extend between the first and second chutes $\mathbf{20}_1$, $\mathbf{20}_2$. The at least one secondary wall segment 102 can abut or reside closely spaced apart (i.e., within about 0.01-0.001 inches) from an adjacent face or faces of the ends of the sidewalls of the metal arc chute 20.

The at least one secondary wall segment 102 can include one secondary wall segment 102 that extends outside the end 20*e* of the first or second arc chute $\mathbf{20}_1$, $\mathbf{20}_2$.

The at least one secondary wall segment 102 can include first and second secondary wall segments 102 that are spaced apart in the length direction, and at least one of which extends outside an end 20*e* of the first or second arc chute $\mathbf{20}_1$, $\mathbf{20}_2$. The first secondary wall segments 102 can have a planar straight vertical outer wall perimeter 102*p* and the second secondary wall segment can have a tapered wall segment 102*t* (FIGS. 3, 4, 6A and 7E).

As shown in FIGS. 3 and 6A, a height of the sidewalls 100*s* at the secondary wall segments 102 can be less than a height along a primary wall segment 101.

Referring to FIGS. 2, 3, 5 and 6A, for example, the at least one secondary wall segment 102 can include a tapered wall segment 102*t* that is external to an end 20*e* of the arc chute 20 and that can taper from a narrow end 102*n* to a wider lower end 102*w* adjacent the floor of the housing 10*f*.

The arc chute 20 can have sidewalls 20*s* with a top 20*t*. The top 111 of the arc quenching member 100 can reside below, flush or above the top 20*t* of the sidewalls 20*s* of the metal arc chute 20. FIG. 2 shows the top 111 above the top 20*t* of the arc chute.

As shown in FIG. 1, the upwardly extending sidewalls 100*s* can terminate at a vertical height "H" that is above the top or vertex of the moving contact 50, at least when the circuit breaker is ON and able to pass current. In some embodiments, the top of the moving contact 50 can reside at a distance of less than 1 inch, typically about 0.09 inches to about 0.10 inches, below the top of the sidewalls 111 when the circuit breaker is ON.

In some embodiments, the sidewalls 20*s* of the arc chute 20 can have a height that is under 1 inch, typically between 0.6 inches and 0.4 inches and an overall length "L" that is under 1.5 inches, typically about 0.90 inches, in a length direction.

Where two adjacent and aligned parallel chutes $\mathbf{20}_1$, $\mathbf{20}_2$ are used, each can have the same length or different lengths and together provide the overall length of the arc chute 20.

The primary segments 101 of the sidewalls 100*s* of the arc quenching member 100 can have a corresponding height or may be taller or shorter and can reside inside the cavity 20*c* of the arc chute 20 for at least a major segment of their height.

FIGS. 6A and 7A-7E illustrate another embodiment of the arc quenching member 100'. In this embodiment, the sidewalls 100*s* terminate at the cross segments $\mathbf{106}_1$, $\mathbf{106}_2$. Compare, for example, the length of the sidewalls 100*s* with the embodiment shown in FIG. 5 which has the sidewalls 100*s* extending past one of the cross segments $\mathbf{106}_1$. The embodiment shown in FIGS. 6A and 6B can position the arc chute member 100' over a single one of the arc chutes $\mathbf{20}_2$ or over only a subset of the length L of the one or both arc chutes $\mathbf{20}_1$, $\mathbf{20}_2$ with one secondary segment 102 or first and second opposing secondary segments 102 extending between the first and second arc chutes $\mathbf{20}_1$, $\mathbf{20}_2$ and one or first and second opposing secondary segments 102 extending off a single end 20*e* of one of the chutes $\mathbf{20}_2$. The reduced length of the arc quenching member 100' can reduce the amount of force applied to the fasteners 12 which hold the casing members together that can be generated by the arc quenching member 100' during an arcing event.

The arc quenching member 100, 100' can have an end closest to the stationary contact 65 that resides a distance between 0.40 inches and 0.80 inches from the fastener cylindrical channel 12.

Figure 6B:
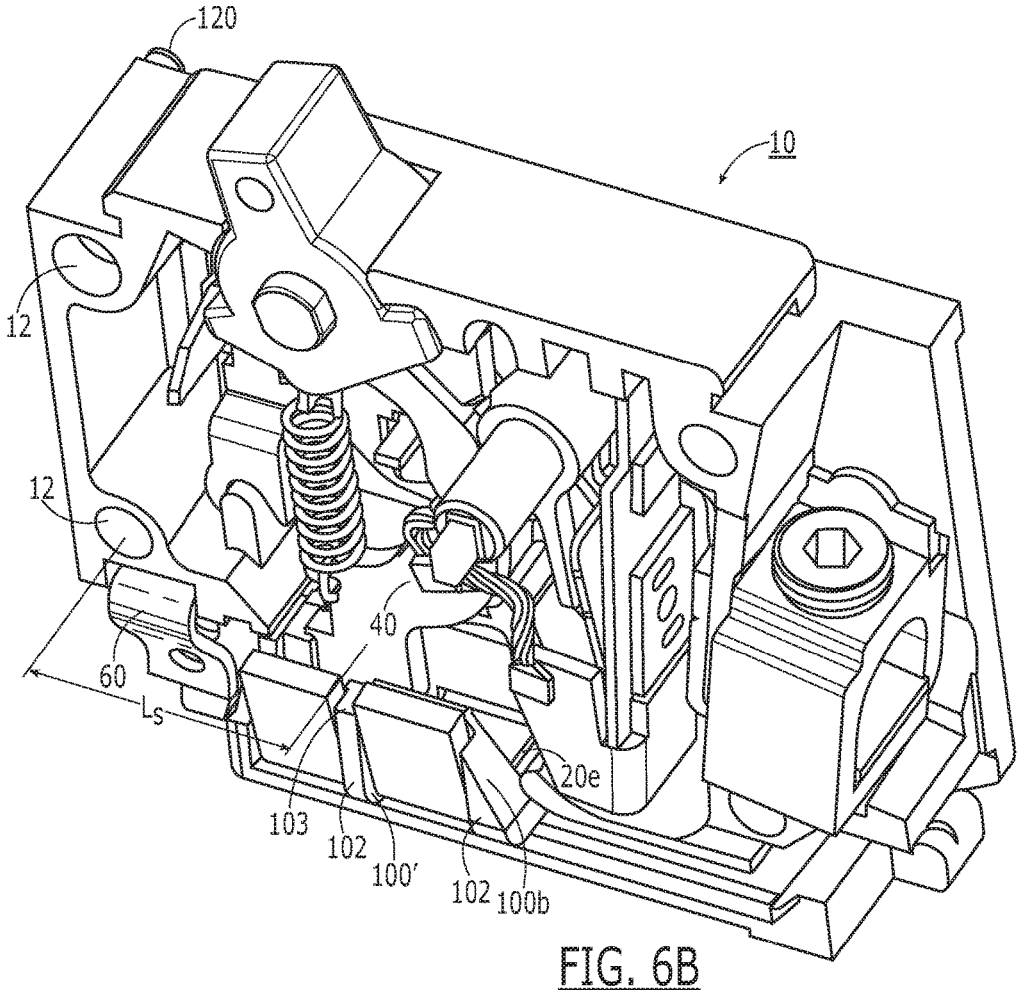
FIG. 6B is a partial side view of a circuit breaker with the arc quenching member of FIG. 6A according to embodiments of the present invention.
Figure 7A:
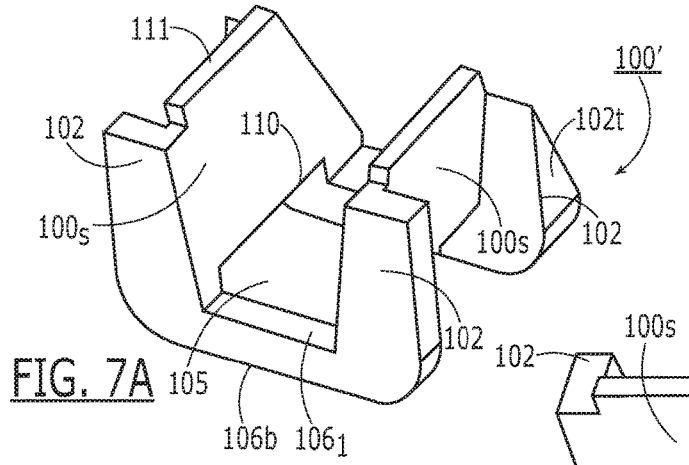
FIG. 7A is a top, side perspective view of the arc quenching member shown in FIG. 6A.
Figure 7B:
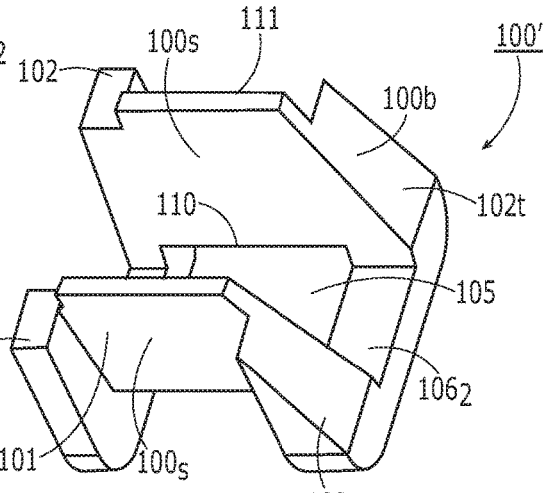
FIG. 7B is a top, front side perspective view of the arc quenching member shown in FIG. 7A.
Figure 7C:
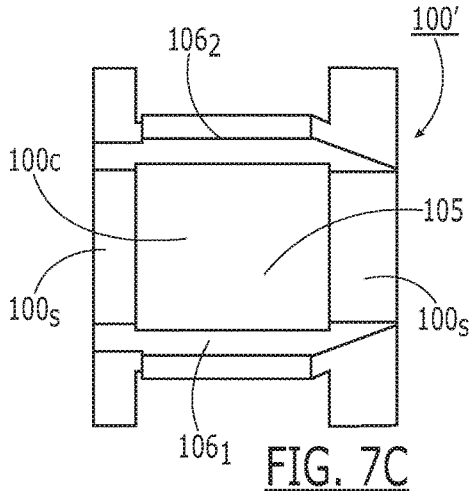
FIG. 7C is a top view of the arc quenching member shown in FIG. 7A.
Figure 7D:
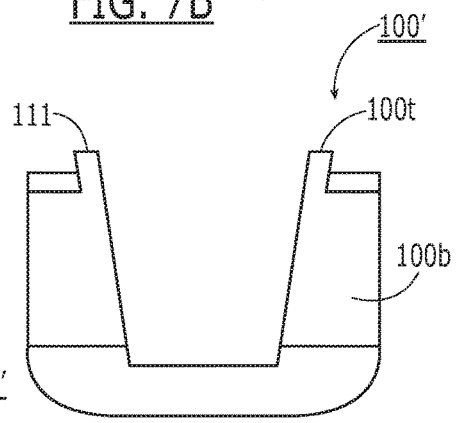
FIG. 7D is an end view of the arc quenching member shown in FIG. 7A.
Figure 7E:
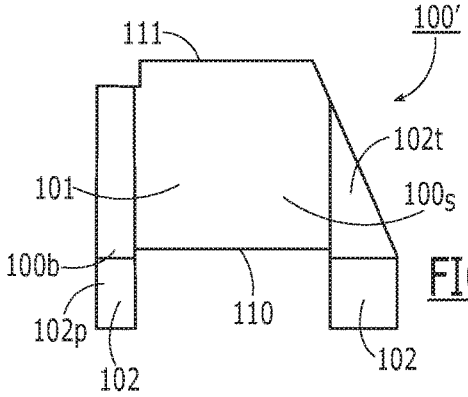
FIG. 7E is a front view of the arc quenching member shown in FIG. 7A.

In some embodiments, the arc quenching member 100' can reside a distance in a length dimension Ls (FIGS. 1 and 6B) away from the closest fastener 120 and cylindrical channel 12 (adjacent the line contact) that is between 0.25 inches and 1 inch, typically between 0.40 inches and 0.80 inches, and may be between 0.460 inches and 0.770 inches, in some embodiments. The distance Ls in FIG. 6B is less than that of FIG. 1, typically by about 20%-to about 50% less.

Referring again to FIGS. 5 and 6A, the arc quenching member 100, 100' can, prior to assembly with the arc chute 20, be a free standing, self-supporting member with only two laterally opposing sidewalls 100*s* facing each other across a cavity 100*c* and no end walls. That is the sidewalls

100*s* can terminate at each end of the cavity 100*c* into an open laterally and upwardly extending free open channel space that allows the moving arm 40 to move back and forth in the cavity 100*c*.

As shown in FIG. 3, for example, the arc quenching member 100 can reside directly on the sidewalls 20*s* of the arc chute 20 and have minimal (less than 20% of a width and/or length of the floor 20*f*), if any, contact with the floor 20*f*.

The arc chute 20 can have a solid, continuous floor 20*f* or base 20*b* and the arc quenching member 100, 100' can have a bottom with a perimeter that exposes the floor 20*f*.

The contacts 50, 65 can comprise about 25% Ag to about 97% Ag by weight. In some embodiments, the circuit breakers 10 can be DC circuit breakers, AC circuit breakers, or both AC (alternating current) and DC (direct current) circuit breakers.

Figure 8:
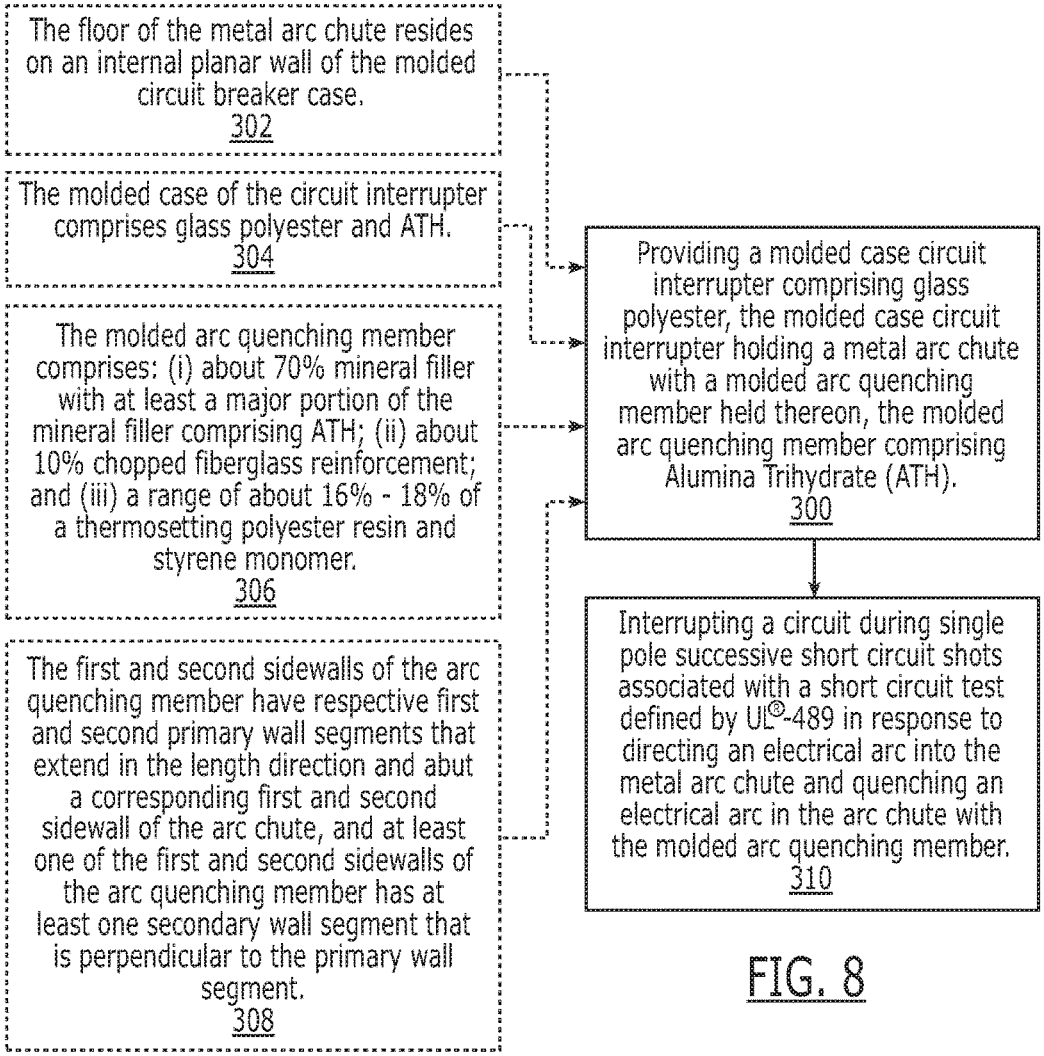
FIG. 8 is a flow chart of exemplary actions of a circuit breaker according to embodiments of the present invention.

FIG. 8 illustrates features associated with a method of operating a circuit interrupter. As shown, a molded case circuit interrupter comprising glass polyester is provided, the molded case circuit interrupter holding a metal arc chute with a molded arc quenching member held thereon, the molded arc quenching member comprising Alumina Trihydrate (ATH) (block 300). A circuit is interrupted during single pole successive short circuit shots associated with a short circuit test defined by UL®-489 in response to directing an electrical arc into the metal arc chute and quenching an electrical arc in the arc chute with the molded arc quenching member (block 310).

The floor of the metal arc chute resides on an internal planar wall of the molded circuit breaker case (block 302). The molded case of the circuit interrupter comprises glass polyester and ATH (block 304). The molded arc quenching member comprises: (i) about 70% mineral filler with at least a major portion of the mineral filler comprising ATH; (ii) about 10% chopped fiberglass reinforcement; and (iii) a range of about 16%-18% of a thermosetting polyester resin and styrene monomer (block 306).

The first and second sidewalls of the arc quenching member have respective first and second primary wall segments that extend in the length direction and abut a corresponding first and second sidewall of the arc chute, and at least one of the first and second sidewalls of the arc quenching member has at least one secondary wall segment that is perpendicular to the primary wall segment (block 308).

The circuit breakers 10 can be rated for voltages between about 1V to about 5000 volts (V) DC and/or may have current ratings from about 15 to about 2,500 Amps. The circuit breakers 10 may be high-rated miniature molded case circuit breakers, e.g., 240V and above about 70 A in a compact package. However, it is contemplated that the circuit breakers 10 and components thereof can be used for any voltage, current ranges and are not limited to any particular application as the circuit breakers can be used for a broad range of different uses.

As discussed above, the circuit breakers 10 can be molded case circuit breakers (MCCB)s. MCCBs are well known. See, e.g., U.S. Pat. Nos. 4,503,408, 4,736,174, 4,786,885, and 5,117,211, the contents of which are hereby incorporated by reference as if recited in full herein. The circuit breakers 10 can be a bi-directional DC MCCB. See, e.g., U.S. Pat. No. 8,222,983, the content of which is hereby incorporated by reference as if recited in full herein. The DC MCCBs can be suitable for many uses such as data center, photovoltaic, and electric vehicle applications.

As is known to those of skill in the art, Eaton Corporation has introduced a line of MCCBs designed for commercial and utility scale photovoltaic (PV) systems. Used in solar combiner and inverter applications, Eaton PVGard™ circuit breakers are rated up to 600 Amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A circuit breaker, comprising:

a molded circuit breaker case, wherein the molded circuit breaker case comprises glass polyester;

a metal arc chute having a base and first and second sidewalls that are laterally spaced apart and extend in a length direction, the metal arc chute comprising an open cavity with the base providing a floor of the open cavity;

a rigid or semi-rigid three dimensional arc quenching member having first and second sidewalls that are laterally spaced apart and extend in the length direction coupled to the arc chute and residing in the cavity of the arc chute;

a movable arm holding a contact adjacent the arc chute; and a line conductor electrically connected to a stationary contact residing adjacent to the arc chute facing the contact on the movable arm.

2. The circuit breaker of claim 1, wherein the arc quenching member comprises a molded body comprising alumina trihydrate (ATH), and wherein the molded circuit breaker case also comprises ATH, but in an amount by weight that is less than that in the arc quenching member.

3. The circuit breaker of claim 1, wherein the first and second sidewalls of the arc quenching member each have a primary wall segment that extends in the length direction, and wherein the first and second sidewalls each have at least one secondary wall segment that is perpendicular to the primary wall segment and extend outward away from the cavity.

4. The circuit breaker of claim 3, wherein the first and second sidewalls each have a plurality of secondary wall segments that are spaced apart in the length direction, and wherein the arc quenching member leaves at least a major portion of the floor of the base of the arc chute exposed.

5. The circuit breaker of claim 1, wherein the metal arc chute comprises first and second metal arc chutes that are adjacent and aligned in the length direction with a space therebetween, wherein the first and second sidewalls of the arc quenching member each have a primary wall segment that extends in the length direction, and wherein at least one of the first and second sidewalls have a secondary wall segment that is perpendicular to the primary wall segment and extends outward through the space between the first and second metal arc chutes away from the cavity.

6. The circuit breaker of claim 5, wherein the second metal arc chute resides closer to the stationary contact than the first metal arc chute, and wherein the primary wall segment of the first and second sidewalls of the arc quenching member terminate prior to an end portion of the second metal arc chute.

7. The circuit breaker of claim 6, wherein the primary wall segment of the first and second sidewalls of the arc quenching member terminate adjacent opposing first and second ends of the first metal arc chute in the length direction, and wherein the arc quenching member and the molded circuit breaker case both comprise alumina trihydrate (ATH) with the arc quenching member comprising more ATH by weight of the molded body and composition used to mold the arc quenching member than the molded circuit breaker case.

8. The circuit breaker of claim 1, wherein the floor of the metal arc chute resides on an internal planar wall of the molded circuit breaker case, wherein the molded circuit breaker case comprises an internal shaped cavity that holds the arc quenching member and the metal arc chute as a unit therein, and wherein the molded circuit breaker case comprises a cylindrical channel for holding a fastener adjacent a line terminal assembly, and wherein the arc quenching member has an end closest to the stationary contact that resides a distance between 0.40 inches and 0.80 inches from the fastener cylindrical channel.

9. The circuit breaker of claim 1, wherein a primary wall segment of the first and second sidewalls of the arc quenching member extend a distance above the first and second sidewalls of the metal arc chute, and wherein at least one secondary wall segment of the first and/or second sidewall is perpendicular to the primary wall segment and has a height that is less than the primary wall segment and the sidewalls of the metal arc chute.

10. The circuit breaker of claim 1, wherein the floor of the base of the metal arc chute is a closed surface, and wherein primary wall segments of the first and second sidewalls of the arc quenching member are conformal to the first and second sidewalls of the metal arc chute and angle outward from the base.

11. A circuit breaker, comprising:

a molded circuit breaker case, wherein the molded circuit breaker case comprises glass polyester;

a metal arc chute having a base and first and second sidewalls that are laterally spaced apart and extend in a length direction, the metal arc chute comprising an open cavity with the base providing a floor of the open cavity;

a rigid or semi-rigid three dimensional arc quenching member having first and second sidewalls that are laterally spaced apart and extend in the length direction coupled to the arc chute and residing in the cavity of the arc chute;

a movable arm holding a contact adjacent the arc chute; and a line conductor electrically connected to a stationary contact residing adjacent to the arc chute facing the contact on the movable arm, wherein the arc quenching member comprises a molded body comprising: (i) about 70% mineral filler of which a majority is alumina trihydrate (ATH); (ii) about 10% chopped fiberglass reinforcement; and (iii) a range of about 16%-18% of a thermosetting polyester resin and styrene monomer.

12. A circuit breaker, comprising:

a molded circuit breaker case, wherein the molded circuit breaker case comprises glass polyester;

a metal arc chute having a base and first and second sidewalls that are laterally spaced apart and extend in a length direction, the metal arc chute comprising an open cavity with the base providing a floor of the open cavity;

a rigid or semi-rigid three dimensional arc quenching member having first and second sidewalls that are laterally spaced apart and extend in the length direction coupled to the arc chute and residing in the cavity of the arc chute;

a movable arm holding a contact adjacent the arc chute; and a line conductor electrically connected to a stationary contact residing adjacent to the arc chute facing the contact on the movable arm, wherein the first and second sidewalls of the arc quenching member have respective first and second primary wall segments that extend in the length direction and abut a corresponding first and second sidewall of the arc chute, and wherein at least one of the first and second sidewalls of the arc quenching member has at least one secondary wall segment that is perpendicular to the primary wall segment.

13. The circuit breaker of claim 12, wherein the at least one secondary wall segment is a plurality of secondary wall segments, at least one extending about an external first end of the metal arc chute on an end away from a stationary contact.

14. The circuit breaker of claim 12, wherein the at least one secondary wall segment has a maximal thickness in the length direction that is greater than a maximal thickness of the primary wall segment, the thickness of the primary wall segment measured in a direction perpendicular to the length direction.

15. The circuit breaker of claim 14, wherein the maximal thickness of the primary wall segment is in a range of about 0.03 inches and 0.06 inches, wherein the maximal thickness of the secondary wall segment is between 0.08 inches and 0.25 inches, and wherein a wall thickness of the sidewalls of the metal arc chute is greater than the maximal wall thickness of the primary wall segment.

16. An arc chute assembly for a molded circuit breaker, comprising:

a metal arc chute having a base and first and second sidewalls that are laterally spaced apart and extend in a length direction, the metal arc chute comprising an open cavity with the base providing a floor of the open cavity; and a rigid or semi-rigid three dimensional arc quenching member having first and second sidewalls that are laterally spaced apart and extend in the length direction coupled to the arc chute and residing in the cavity of the arc chute leaving at least a major portion of the floor of the base of the arc chute exposed, wherein the arc quenching member comprises a molded body comprising alumina trihydrate (ATH).

17. The arc chute assembly of claim 16, wherein the molded body comprises: (i) about 70% mineral filler of which a majority is the alumina trihydrate (ATH); (ii) about 10% chopped fiberglass reinforcement; and (iii) a range of about 16%-18% of a thermosetting polyester resin and styrene monomer.

18. The arc chute assembly of claim 16, wherein the first and second sidewalls of the arc quenching member have respective first and second primary wall segments that extend in the length direction and abut a corresponding first and second sidewall of the arc chute, and wherein at least one of the first and second sidewalls of the arc quenching member has at least one secondary wall segment that is perpendicular to the primary wall segment.

19. A method for operating a current interrupter comprising:

providing a molded case circuit interrupter comprising glass polyester, the molded case circuit interrupter holding a metal arc chute with a molded arc quenching member held thereon, the molded arc quenching member comprising alumina trihydrate (ATH); and interrupting a circuit during single pole successive short circuit shots associated with a short circuit test defined by UL®-489 in response to directing an electrical arc into the metal arc chute and quenching an electrical arc in the arc chute with the molded arc quenching member.

20. The method of claim 19, wherein the molded arc quenching member comprises: (i) about 70% mineral filler with at least a major portion of the mineral filler comprising ATH; (ii) about 10% chopped fiberglass reinforcement; and (iii) a range of about 16%-18% of a thermosetting polyester resin and styrene monomer.

21. The method of claim 20, wherein the first and second sidewalls of the arc quenching member have respective first and second primary wall segments that extend in the length direction and abut a corresponding first and second sidewall of the arc chute, and at least one of the first and second sidewalls of the arc quenching member has at least one secondary wall segment that is perpendicular to the primary wall segment.

22. The method of claim 19, wherein a base of the metal arc chute resides on a planar internal wall of the molded circuit breaker case, and wherein the molded case circuit interrupter further comprises ATH.

* * * * *